US009384912B2

(12) United States Patent
Curnis et al.

(10) Patent No.: US 9,384,912 B2
(45) Date of Patent: Jul. 5, 2016

(54) CIRCUIT BREAKER

(71) Applicant: ABB S.p.A., Milan (IT)

(72) Inventors: Maurizio Curnis, Carvico (IT); Edoardo Scola, Lecco (IT)

(73) Assignee: ABB S.P.A., Milan (IT)

( * ) Notice: Subject to any disclaimer, the term of this patent is extended or adjusted under 35 U.S.C. 154(b) by 31 days.

(21) Appl. No.: 14/451,989

(22) Filed: Aug. 5, 2014

(65) Prior Publication Data

US 2015/0041293 A1 Feb. 12, 2015

(30) Foreign Application Priority Data

Aug. 7, 2013 (EP) ..... 13179543

(51) Int. Cl.

| | |
|---|---|
| ***H01H 9/02*** | (2006.01) |
| ***H01H 3/38*** | (2006.01) |
| ***H01H 3/46*** | (2006.01) |

(Continued)

(52) U.S. Cl.

CPC . *H01H 9/02* (2013.01); *H01H 3/38* (2013.01); *H01H 3/46* (2013.01); *H01H 3/60* (2013.01); *H01H 71/0214* (2013.01); *H01H 71/505* (2013.01); *H01H 1/221* (2013.01); *H01H 1/50* (2013.01); *H01H 1/5822* (2013.01); *H01H 3/30* (2013.01); *H01H 69/01* (2013.01); *H01H 71/1009* (2013.01); *H01H 71/504* (2013.01); *H01H 2235/01* (2013.01); *H01H 2235/012* (2013.01)

(58) Field of Classification Search

CPC ..... H01H 3/38; H01H 71/505; H01H 3/60; H01H 9/02; H01H 2235/01; H01H 2235/012; H01H 1/221; H01H 1/50; H01H 1/5822; H01H 3/30; H01H 69/01; H01H 71/0214; H01H 71/1009; H01H 74/504; H01H 3/46

USPC ..... 200/288, 293, 400

See application file for complete search history.

(56) References Cited

U.S. PATENT DOCUMENTS

| | | | | |
|---|---|---|---|---|
| 5,223,681 | A | 6/1993 | Buehler et al. | |
| 5,298,874 | A * | 3/1994 | Morel | H01H 1/2058 335/10 |

(Continued)

FOREIGN PATENT DOCUMENTS

| | | |
|---|---|---|
| DE | 201 21 223 U 1 | 6/2003 |
| EP | 0 918 348 A2 | 5/1999 |
| WO | WO 93/08585 | 4/1993 |

OTHER PUBLICATIONS

European Search Report mailed on Jan. 1, 2014, Application No. 13179543.7.

*Primary Examiner* — Edwin A. Leon

(74) *Attorney, Agent, or Firm* — Taft Stettinius & Hollister LLP

(57) ABSTRACT

A circuit breaker is shown which includes a plurality of fixed contacts and a plurality of corresponding movable contacts. An actuating shaft is operatively connected to and actuates the plurality of movable contacts to couple with/separate from the corresponding fixed contacts. A supporting device for the actuating shaft can be movably connected to a wall of the circuit breaker, and the actuating shaft can be operatively coupled to the supporting device to rotate around a rotation axis relative to the wall of the circuit breaker and the supporting device itself. The circuit breaker can include an adjustment device for adjusting at least the position of the actuating shaft relative to the wall.

20 Claims, 12 Drawing Sheets

(51) Int. Cl.

| | |
|---|---|
| ***H01H 3/60*** | (2006.01) |
| ***H01H 71/02*** | (2006.01) |
| *H01H 1/22* | (2006.01) |
| *H01H 1/50* | (2006.01) |
| *H01H 1/58* | (2006.01) |
| *H01H 3/30* | (2006.01) |
| *H01H 69/01* | (2006.01) |
| *H01H 71/10* | (2006.01) |
| *H01H 71/50* | (2006.01) |

(56) References Cited

U.S. PATENT DOCUMENTS 5,628,394 A * 5/1997 Benke ..... H02B 11/133
200/400
5,945,605 A 8/1999 Julian et al.
6,541,727 B2 * 4/2003 Beck ..... H01H 71/52
200/400

* cited by examiner

CIRCUIT BREAKER

RELATED APPLICATION(S)

This application claims priority under 35 U.S.C. §119 to European Application No. 13179543.7 filed in Europe on Aug. 7, 2013, the entire content of which is hereby incorporated by reference in its entirety.

FIELD

The present disclosure relates to a circuit breaker; for example, a circuit breaker, which can be suitable to be realized as a low-voltage circuit breaker such as an air circuit breaker ("ACB"), and other suitable types of circuit breakers, for example, circuit breakers with insulated poles, for example, vacuum circuit breakers.

BACKGROUND INFORMATION

Low-voltage industrial electrical systems having high currents and power levels can use specific devices, commonly known in the art as automatic power circuit breakers.

Automatic power circuit breakers can be designed for the correct operation of the electrical system in which they are inserted and the loads connected to the circuit breakers. For example, circuit breakers can help ensure the nominal current needed for the various users, allow correct insertion and disconnection of the loads with respect to the circuit, protect the loads against abnormal events such as overloading and short-circuits by opening the circuit automatically, and allow disconnect between the protected circuit by galvanic separation or by the opening of suitable contacts in order to achieve full isolation of the load with respect to the electric power source.

Known circuit breakers can be available according to various industrial embodiments, and can include one or more electrical poles having each at least one fixed contact and a corresponding movable contact which can be reciprocally coupled to/separated from each other.

The actuation of the movable contacts can be realized by controller, which can include a mechanism, which can include, for example, pre-charged opening springs, and a rotating shaft which can be triggered by the mechanism and can be operatively connected to the mobile contacts of the various poles by a suitable kinematic chain.

The actuating shaft can be connected, for example, at its end parts, to walls or flanks of the circuit breaker, in such a way that the flanks can mechanically support the shaft while allowing its rotation.

The mounting of the shaft can be important for the proper working of the whole circuit breaker. For example, the shaft should be mounted not only as easily as possible, but also very precisely because its mounted position can directly influence the correct position of the movable contacts among the various poles and relative to the correspondingly associated fixed contacts.

To address this issue, some adjustment mechanisms have been introduced, which can be positioned directly on the mounting flanks or walls of the circuit breaker and which can allow the adjustment of the position of the actuating shaft and therefore of the movable contacts of the various poles.

Although such solutions properly perform the desired functionalities, further improvements, for example, in regards to mounting and final positioning can be desirable.

In addition, such circuit breakers under fault conditions, for example, short-circuits, the flowing current must be interrupted as quickly as possible and therefore the movable contacts should quickly separate from the fixed contacts.

Various solutions have been adopted, some of which can be also used in combination.

For example, the current can be forced to follow a given path so that, when a short circuit occurs, electrodynamic repulsion forces can occur between the contacts. These repulsion forces can generate a thrust that can help increase the separation speed of the moving contacts with respect to the fixed contacts.

Another solution can Increase the energy accumulated in the opening springs of the mechanism, which can be delivered to the actuating shaft and the movable contacts.

Whichever solution is adopted, despite contributing to the generation of the thrust useful for contacts separation, the solution ends up in having a moving contact structure, which can reach the end of its stroke at high speed and therefore with high energy, and which can cause violent impacts of the moving equipment against other parts of the circuit breaker. For example, the moving contacts can bounce back towards the fixed contacts, thus bringing about undesirable restrikes of the electric arc.

To contrast this possibility, known solutions use additional anti-rebound mechanisms to latch the moving contacts in the open position.

However, when the position of the actuating shaft is adjusted, misalignments of the shaft can occur with respect to the anti-rebound mechanism, thus jeopardizing its proper latching function, which can render the presence of the latching mechanism useless.

SUMMARY

A circuit breaker is disclosed comprising: a plurality of fixed contacts; a plurality of corresponding movable contacts; an actuating shaft which is operatively connected to and actuates the plurality of movable contacts between a first position in which each of the movable contacts are coupled with a corresponding fixed contact, and a second position in which each of the plurality of movable contacts are separated from the corresponding fixed contact; a supporting device for the actuating shaft, wherein the supporting device is movably connected to a wall of the circuit breaker, and wherein the actuating shaft is operatively coupled to the supporting device so as to rotate around a rotation axis relative to the wall and the supporting device; and an adjustment means for adjusting a position of the actuating shaft relative to the wall.

A circuit breaker is disclosed comprising: a plurality of fixed contacts; a plurality of corresponding movable contacts; an actuating shaft which is operatively connected to the plurality of movable contacts for actuating the movable contacts between a first position in which each of the movable contacts are coupled with a corresponding fixed contact, and a second position in which each of the movable contacts are separated from the corresponding fixed contact; and a supporting device for the actuating shaft, wherein the supporting device is movably connected to a wall of the circuit breaker, and wherein the actuating shaft is operatively coupled to the supporting device so as to rotate around a rotation axis relative to the wall and the supporting device.

BRIEF DESCRIPTION OF THE DRAWINGS

The subject matter of the disclosure will be explained in more detail in the following text with reference to exemplary embodiments, which are illustrated in the attached drawings, in which.

DETAILED DESCRIPTION

In accordance with an exemplary embodiment, the present disclosure provides a circuit breaker where mounting of the actuating shaft can allow a fine adjustment of the shaft position relative to an anti-rebound mechanism.

In accordance with an exemplary embodiment, a circuit breaker is disclosed, which includes a plurality of fixed contacts and a plurality of corresponding movable contacts, an actuating shaft which can be operatively connected to and actuates the plurality of movable contacts between a first position in which the movable contacts can be coupled each with a corresponding fixed contact, and a second position in which the movable contacts can be separated each from the corresponding fixed contact, and a supporting device for the actuating shaft, wherein the supporting device is movably connected to a wall of the circuit breaker, with the actuating shaft which is operatively coupled to the supporting device so as to rotate around a rotation axis relative to the wall and the supporting device itself, and wherein it further comprises adjustment means for adjusting at least the position of the actuating shaft relative to the wall.

Figure 1:
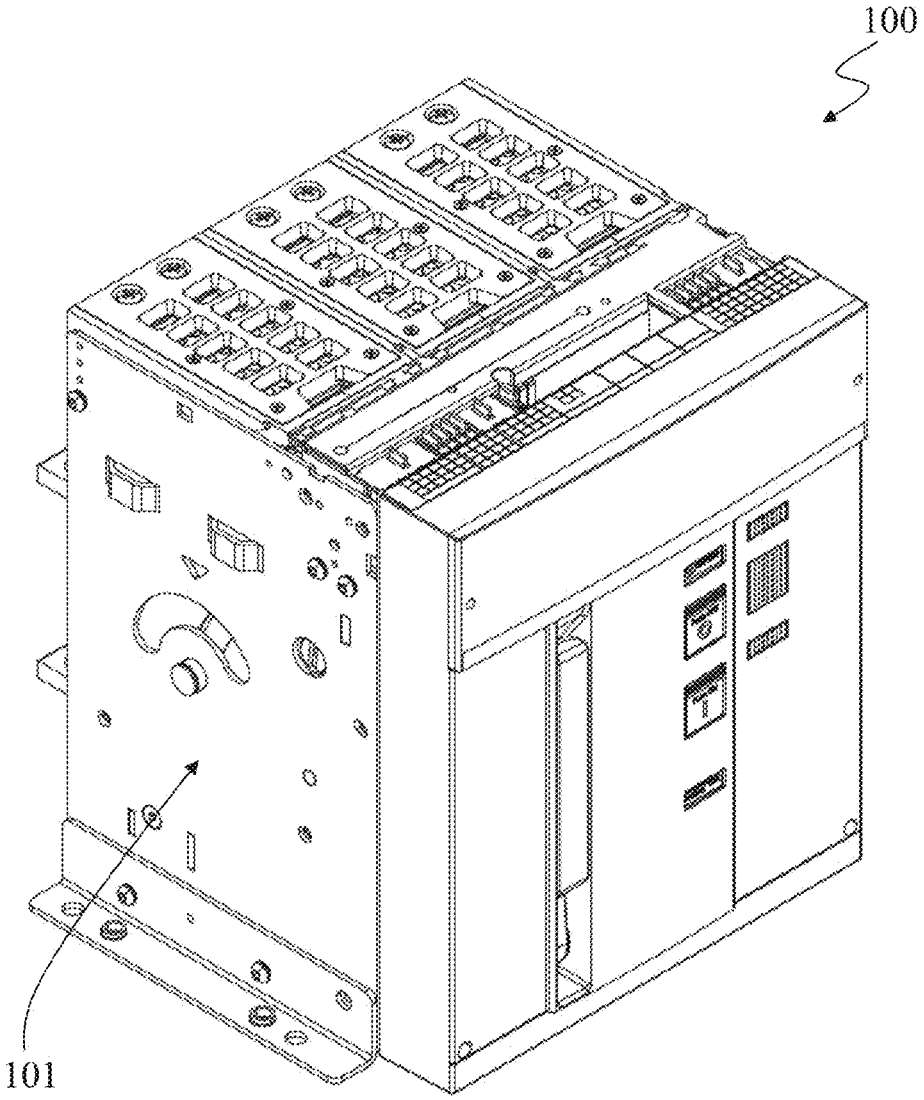
FIG. 1 is a perspective illustrating an exemplary circuit breaker according to the present disclosure.

In accordance with an exemplary embodiment, an exemplary low voltage circuit breaker according to the present disclosure is illustrated in FIG. 1 with the reference number 100.

Figure 5:
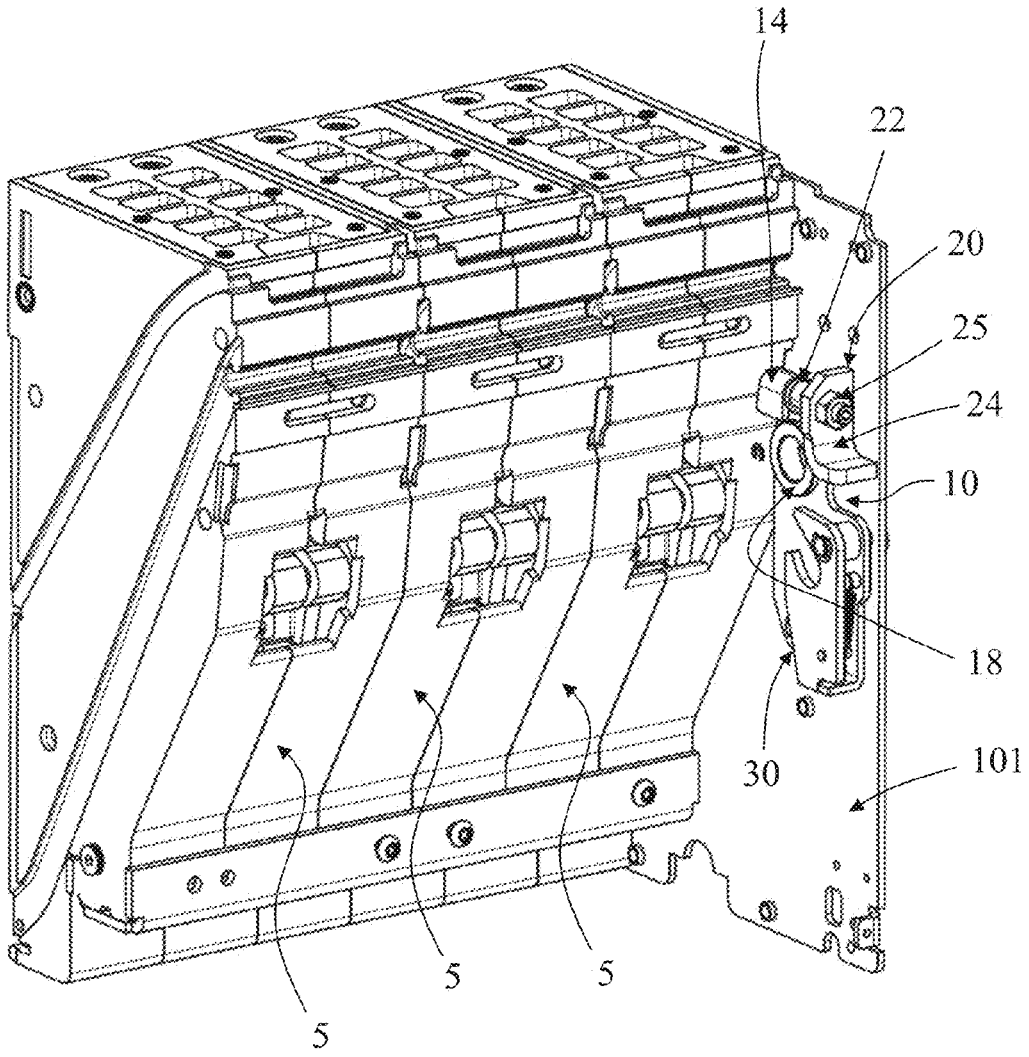
FIG. 5 is a perspective view illustrating a part of the circuit breaker of FIG. 1.
Figure 6:
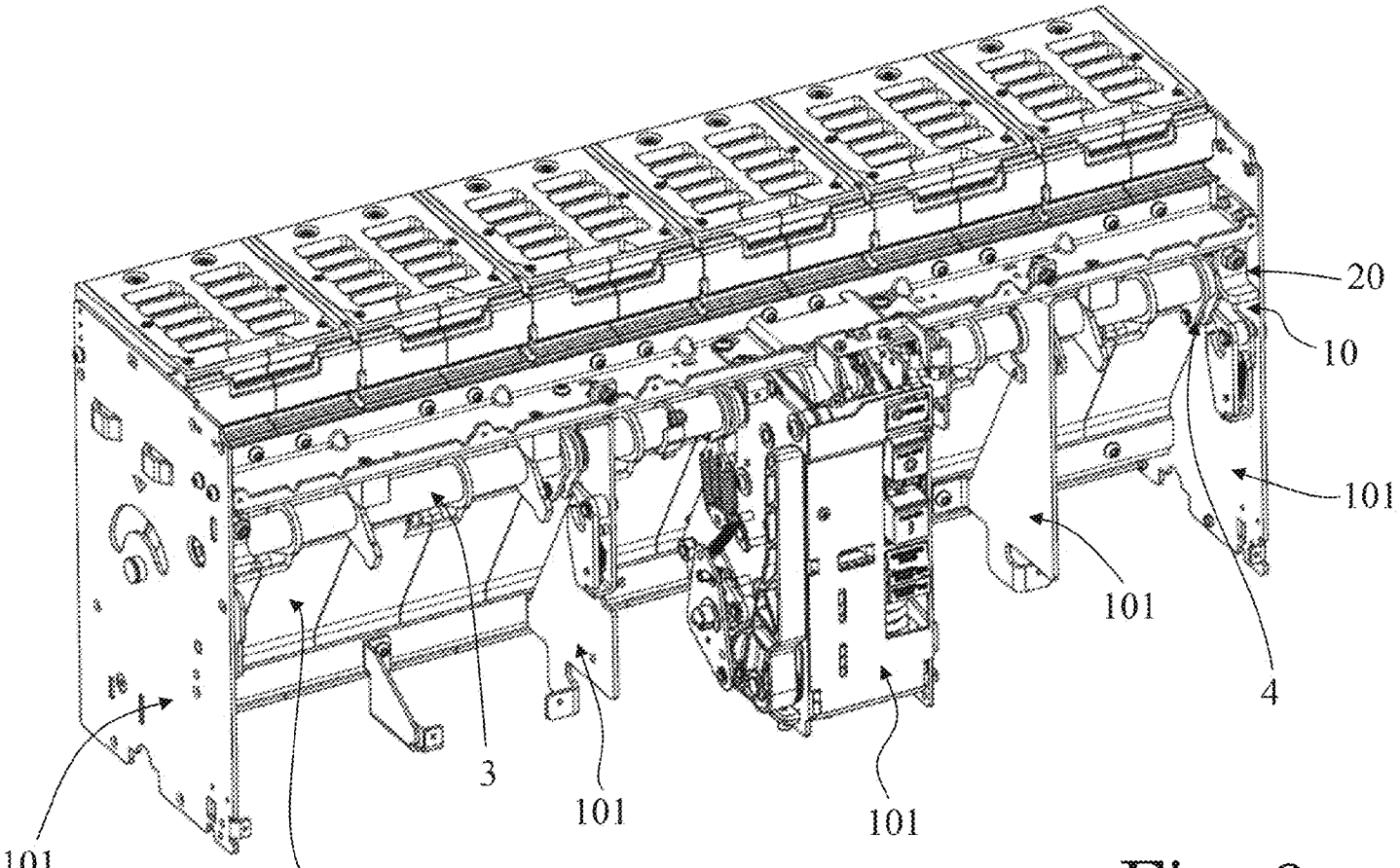
FIG. 6 is a perspective view illustrating a part of an exemplary circuit breaker according the present disclosure.

As shown in FIGS. 5 and 6, the circuit breaker 100 can include a plurality of poles 5 which can be assembled together side by side and can be positioned between side walls or flanks 101 only one of which is depicted in FIG. 5 for the sake of clarity of illustration.

In accordance with an exemplary embodiment, the circuit breaker 100 can include any suitable number of poles 5, for example, three as illustrated in the example of FIG. 5, or for example, six as illustrated in FIG. 6. As illustrated in FIG. 6, the circuit breaker 100 can include one or more additional walls 101, for example, vertical, which can be positioned between the side flanks 101.

The circuit breaker 100 can include a plurality of fixed contacts 1 and a plurality of corresponding movable contacts 2, which can be housed into the various poles 5.

Figure 12:
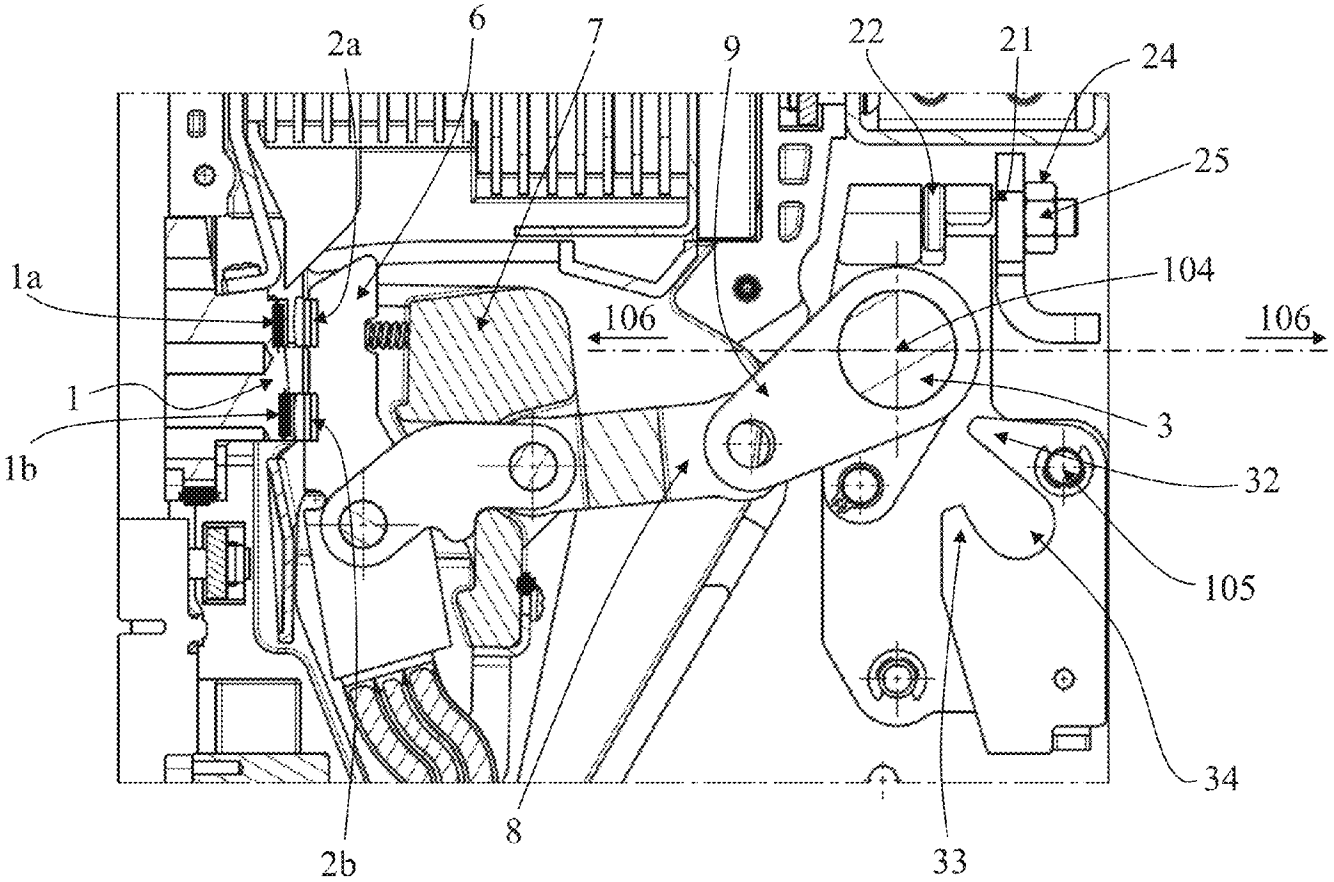
FIG. 12 is cross-section of components of an exemplary circuit breaker according to the present disclosure.

For example, as illustrated FIG. 12, each pole can include a contact finger 6 which can include a movable main contact pad 2*a* and a movable arc contact pad 2*b*. In accordance with an exemplary embodiment, each fixed contact 1 can include a fixed main contact pad 1*a* and a fixed arc contact pad 1*b*, which couple with/separate from the corresponding movable main contact pads 2*a* and movable arc contact pads 2*b*, respectively.

The movable contacts 2 of the various poles 5 can be operatively connected to an actuating shaft 3, which can actuate them between a first position in which the movable contacts 2 can be coupled each with a corresponding fixed contact 1 (circuit breaker closed), and a second position in which the movable contacts 3 can be separated each from the corresponding fixed contact 1 (circuit breaker open).

Figure 2:
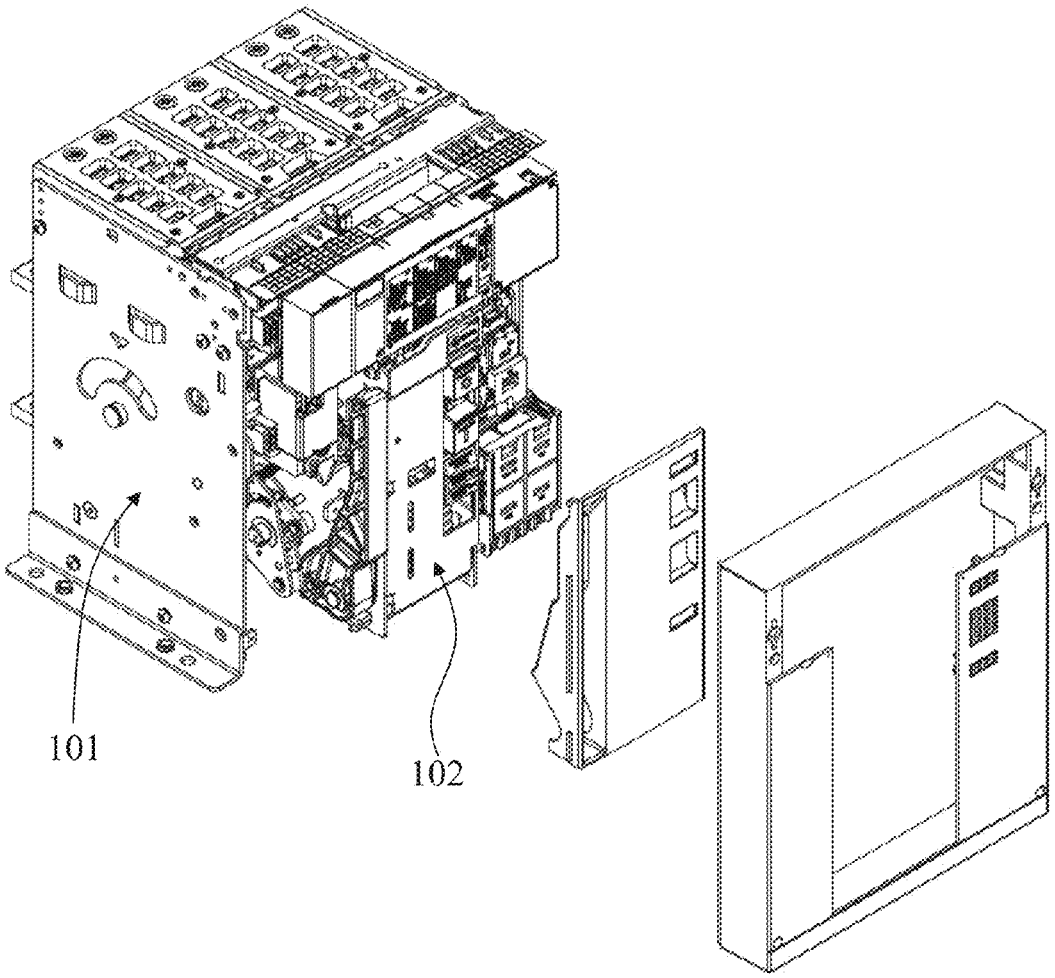
FIG. 2 is an exploded view of the exemplary circuit breaker illustrated in FIG. 1.
Figure 3:
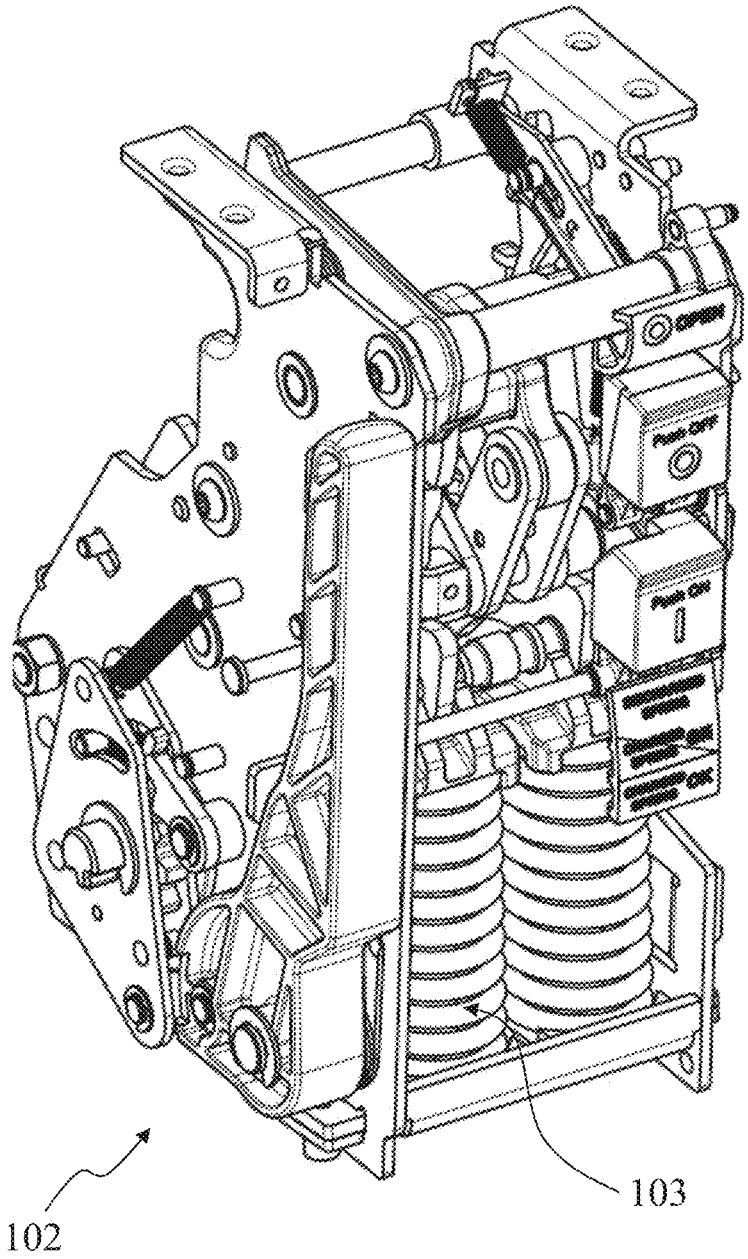
FIG. 3 is a perspective view illustrating an exemplary operating mechanism unit, which can be used in a circuit breaker according to the present disclosure.
Figure 4:
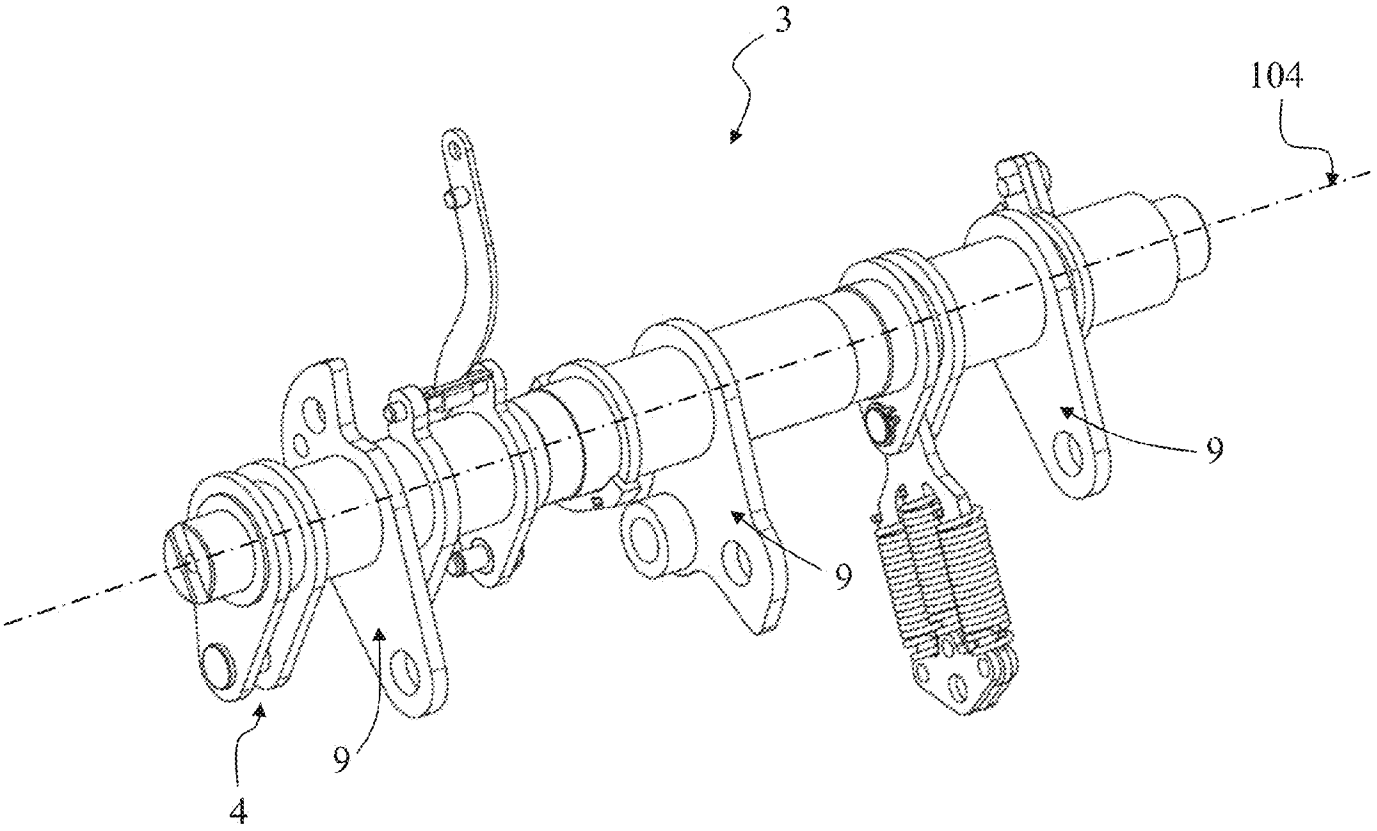
FIG. 4 is a perspective view illustrating an exemplary actuating shaft, which can be used in a circuit breaker according to the present disclosure.

The actuating shaft 3 can be connected to an operating mechanism, an example of which is indicated in FIGS. 2 and 3 by the reference number 102. The operating mechanism 102 can include, for example, one or more opening springs 103, which can supply the energy to actuate the actuating shaft 3 and the movable contacts 2.

In accordance with an exemplary embodiment, for each pole 5 there can be one or more contact fingers 6, which can be mounted on a movable contacts carrier 7. Each movable contacts carrier 7 can be connected to a link rod 8, which can be connected to a corresponding arm 9 keyed directly on the actuating shaft 3.

The circuit breaker 100 can include a supporting device for the actuating shaft 3, which is indicated in the figures by the reference number 10.

For example, in the circuit breaker 100 according to the present disclosure, the supporting device 10 can be movably connected to a wall 101 of the circuit breaker 100 itself, with the actuating shaft 3 which can be operatively coupled to the supporting device 10 so as to rotate, around a first rotation axis 104, relative to the wall 101 and the supporting device 10 itself.

In addition, the circuit breaker 100 according to the present disclosure can include an adjustment means 20 for adjusting at least the position of the actuating shaft 3 relative to the wall 101.

In the exemplary embodiments illustrated, the supporting device 10 can be movably connected to a side flank 101, for example, a vertical wall of the circuit breaker, which can be substantially perpendicular to the rotation axis 104 of the actuating shaft 3.

In accordance with an exemplary embodiment as illustrated in the figures, the supporting device 10 can include an anti-rebound means 30, which can be arranged so as to cooperate with the actuating shaft 3. The anti-rebound means 30 can help prevent the movable contacts 2 from bouncing back towards the fixed contacts 1 when they are actuated by the actuating shaft 3. In accordance with an exemplary embodiment, the movable contacts 2 separate from the fixed contacts 1, and move from a first position (circuit breaker closed) to a second position (circuit breaker open).

In accordance with an exemplary embodiment, the adjusting means 20 can be arranged and operatively connected to the actuating shaft 3 and the supporting device 10 so as to simultaneously adjust the position of the actuating shaft 3 and of the supporting device 10 relative to the mounting wall 101 to which the supporting device 10 is operatively connected.

In accordance with an exemplary embodiment, for example, the adjustment means 20 can be arranged so as to simultaneously adjust the position of the actuating shaft 3 and of the supporting device 10 together with the anti-rebound means 30. In accordance with an exemplary embodiment, the anti-rebounding means 30 can be part of the supporting device 10.

For example, the supporting device 10 can be hinged to the associated mounting wall 101 at a hinging axis (or hinged axis) 105, which can be substantially parallel to the rotation axis 104, and can swivel about the hinging axis 105 itself.

In accordance with an exemplary embodiment, as illustrated in FIG. 12 the adjustment means 20 can be configured to displace (in both directions) the actuating shaft 3 along a reference axis 106, which can be transversal with respect to the rotation axis 104, and for swiveling at the same time the supporting device 10 around its hinging axis 105.

Figure 8:
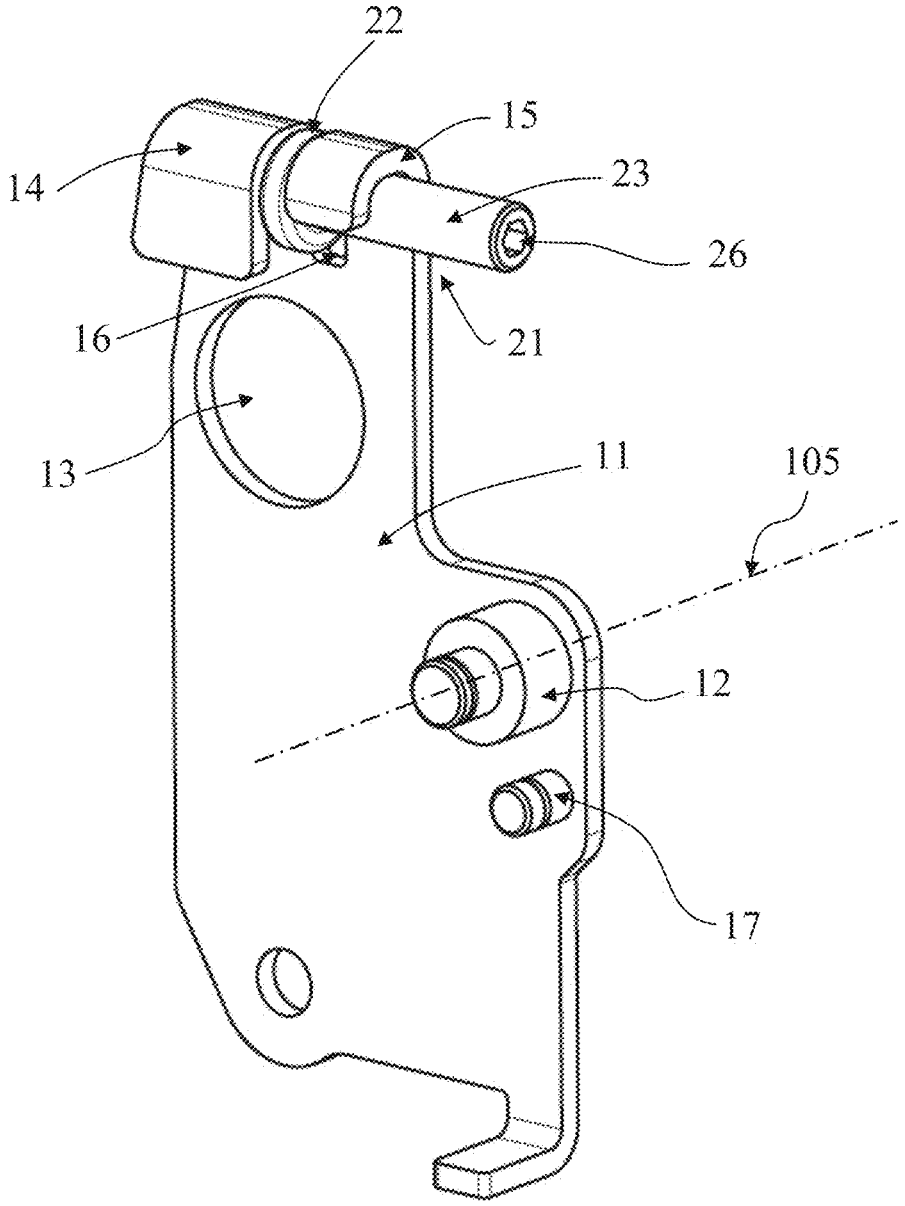
FIG. 8 is a perspective view illustrating components illustrated in FIG. 7.

In an exemplary embodiment illustrated in FIG. 8, the supporting device 10 can include a shaped mounting plate 11 from which a pin 12 can protrude. The protruding pin 12 can be hinged on one side to the wall 101, thus contributing to the hinging axis 105.

The shaped mounting plate 11 can be provided with a hole 13 inside which there is fitted a bushing 18, as illustrated in FIG. 5. In accordance with an exemplary embodiment, a portion of the actuating shaft 3, which can be, for example, one end portion, for example, with a cross section reduced with respect to the main part of the shaft 3, can be entered into the bushing 18 with a rather narrow clearance.

The bushing 18 can form a bearing for the shaft 3 supported by the supporting device 10. In accordance with an exemplary embodiment, for example, the shaft 3, while being supported by the supporting device 10, can rotate inside the bushing 18 with respect to the supporting device 10 itself and relative to the wall 101.

As illustrated, the mounting plate 11 can have an end portion or edges, for example, in the upper part, bent for example, downwardly, to form two hooks 14, 15 with a slit 16 in between.

Figure 7:
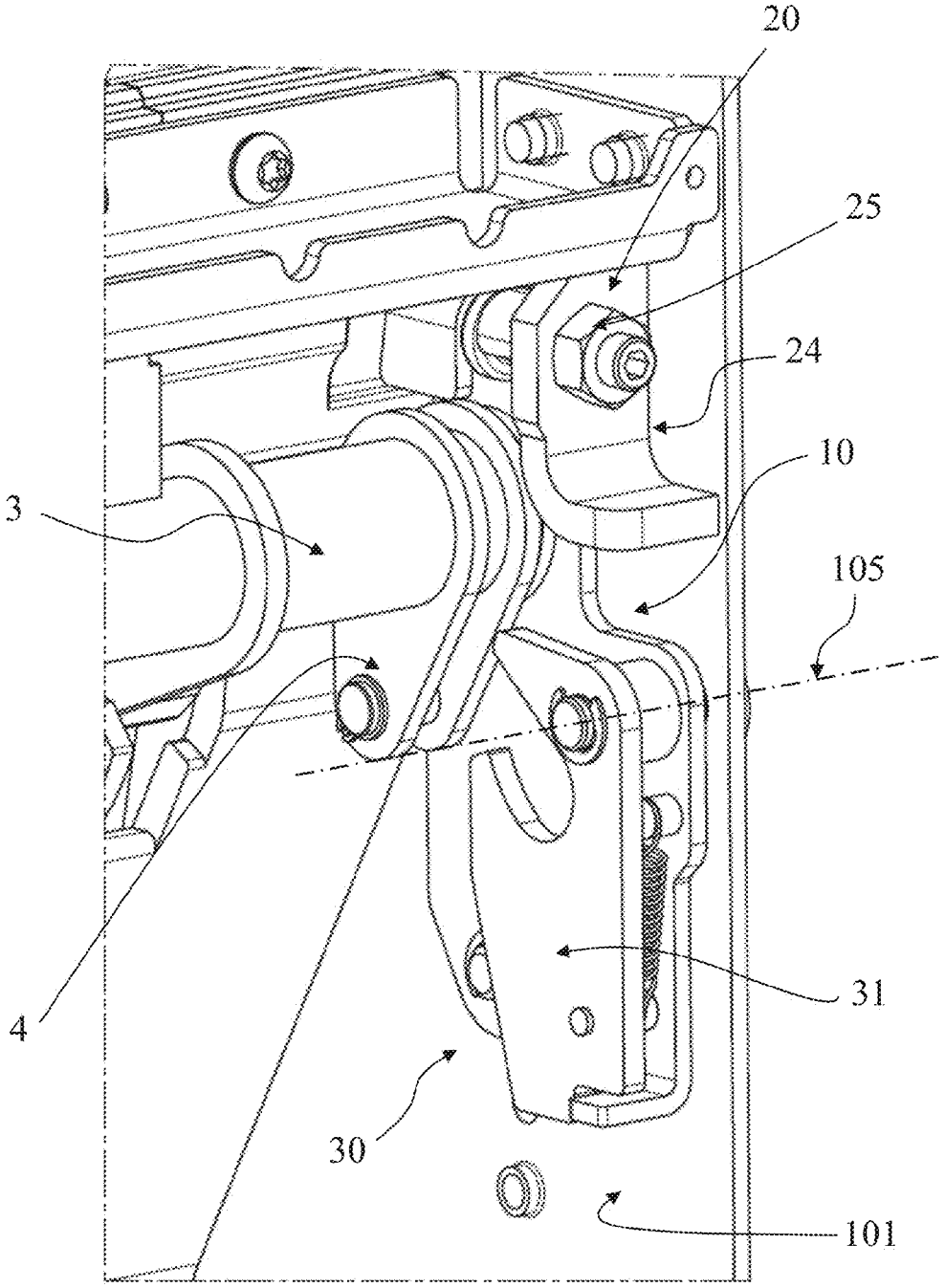
FIG. 7 is a perspective view illustrating components used in an exemplary circuit breaker according to the disclosure.
Figure 9:
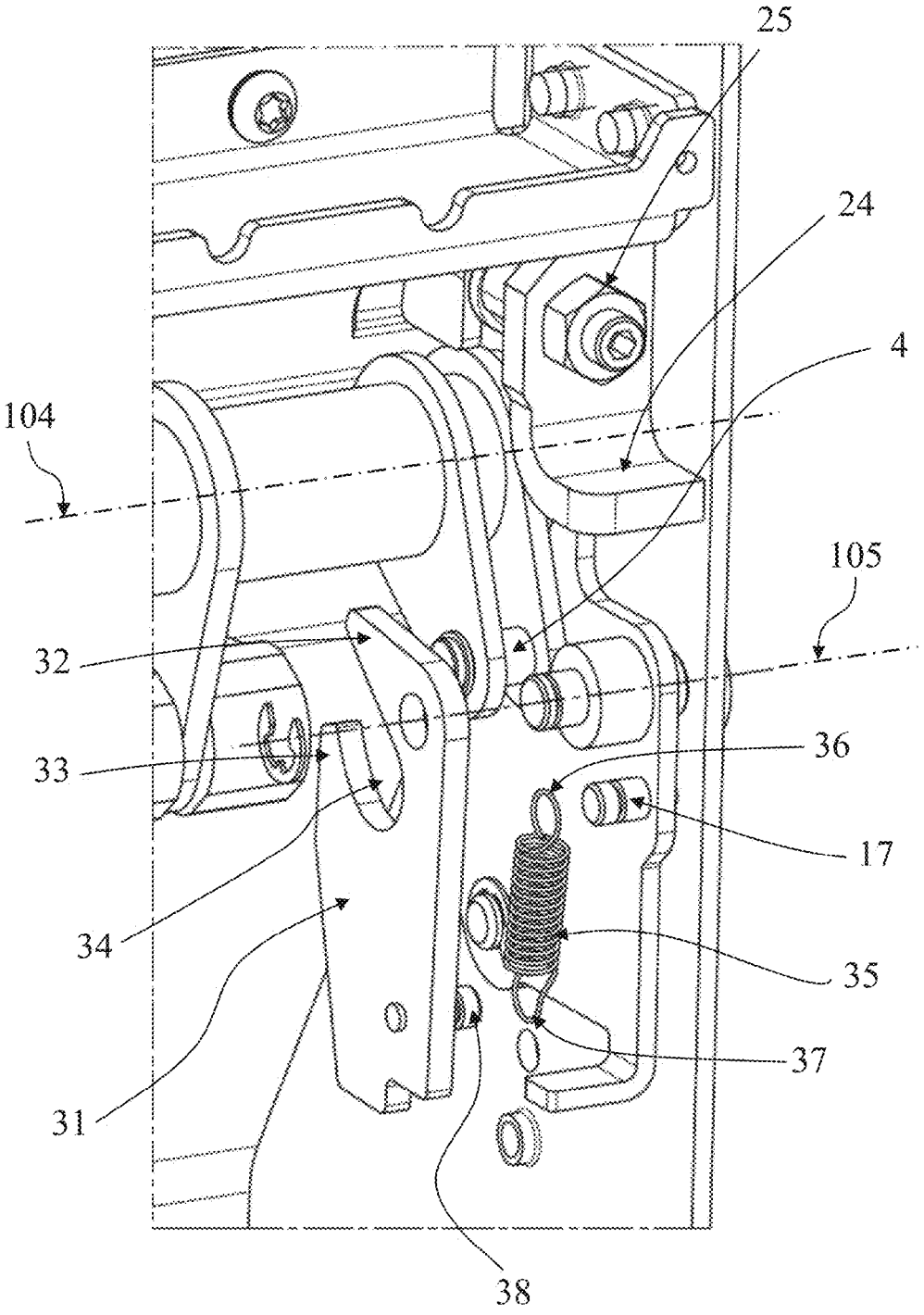
FIG. 9 shows components illustrated in FIG. 7 in an exploded view.

As illustrated for example in FIGS. 7-9, the anti-rebound means 30 can include a hooking plate 31, which can be coupled to a second end of the pin 12 so as to swivel about the hinging axis 105 solidly with the shaped mounting plate 11 under the action of the adjustment means 20, and can rotate around the hinging axis 105 relative to the mounting plate 11, for example, with the mounting plate 11 still in its position, under the action of the actuating shaft 3.

In accordance with an exemplary embodiment, the hooking plate 31 can include a first finger 32 and a second finger 33 delimiting there between an open slot 34. The first and second fingers 32, 33 can be suitable to mechanically interact with an associated portion 4 of the actuating shaft 3 and to guide the associated portion 4 inside the open slot 34 when the actuating shaft 3 rotates to actuate the movable contacts 2 from the first position to the second position.

The anti-rebound means 30 can include a return spring 35 exerting a pulling action on the hooking plate 31. As illustrated, the return spring 35 can be positioned between the shaped mounting plate 11 and the hooking plate 31. The return spring 35 can have a first end 36, which can be hooked to a first connection pin 17, which can protrude from the shaped mounting plate 12 towards the hooking plate 31, and a second end 37 which can be hooked to a second connection pin 38 protruding from the hooking plate 31 towards the shaped mounting plate 11.

In accordance with an exemplary embodiment, the adjustment means 20 can include an adjustment screw 21, illustrated for example in FIG. 8, whose head 22 can be inserted and held into the slit 16 between mutually facing surfaces of the first and second hooks 14, 15. The shank 23 of the screw 21 can run inside the second hook 15 and can pass through a threaded hole provided on a protrusion 24, which can be solid with and can protrude transversally from the associated mounting wall 101.

As illustrated, the adjustment means 20 can include a nut 25, which can be screwed onto the shank 23 to block the actuating shaft 3 and the supporting device 10 in the achieved adjusted position.

In accordance with an exemplary embodiment, when the circuit breaker is assembled, the supporting device 10 can be hinged onto a mounting wall, for example, to a side flank 101 as previously disclosed, with the actuating shaft 3 which can be inserted into the hole 13 so as to be rotatable supported by the supporting device 10 itself. In accordance with an exemplary embodiment, a user can by rotating clockwise or counterclockwise the screw 21, for example, by inserting a tool into the hexagonal hole 26, can adjust the position of the actuating shaft as well as that of the supporting device 10. The screw 21, when rotated, can push against the first hook 14 or the second hook 15, and can move the actuating device 10 (and the anti-rebound means 30 solidly with it) which rotates about the hinging axis 105. At the same time, the actuating shaft 3 can be finely translated along the reference axis 106 along one direction or the opposite one schematically indicated by the depicted arrows.

Once the desired position is achieved, the nut 25 can be screwed onto the shank 23 so as to block the actuating shaft 3 and the whole supporting device 10.

In accordance with an exemplary embodiment, the position of the actuating shaft 3 can not only be adjusted, but also the correct relative positioning between the actuating shaft 3 and the anti-rebound means 30 can be maintained.

Thus, when the circuit breaker 100 is in operation and should open, for example, due to a fault, under the action of the operating command 102, the actuating shaft 3 starting for example from the position depicted in FIG. 7 can rotate so as to bring the various movable contacts 2 away from the corresponding fixed contacts 1.

Figure 10:
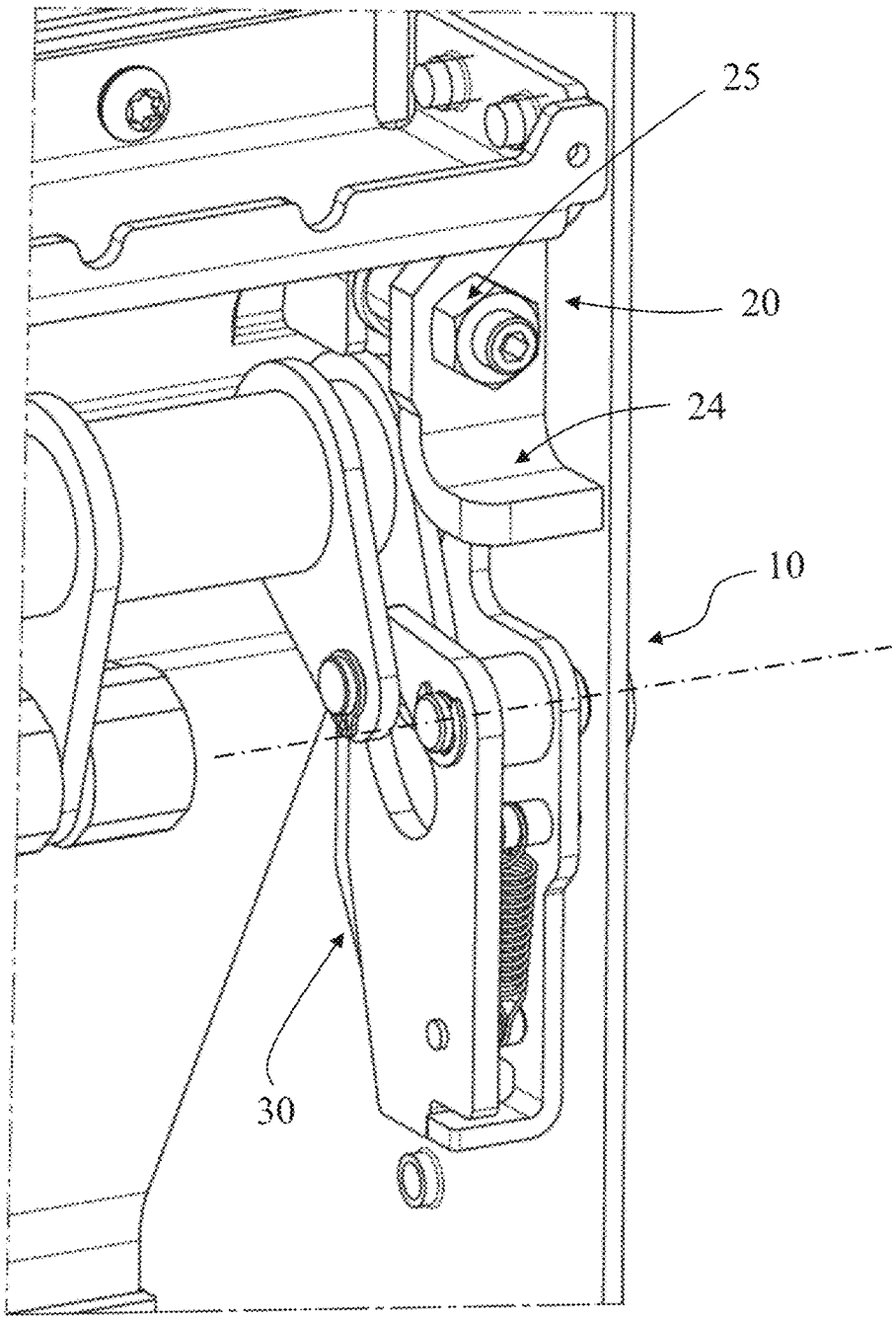
FIG. 10 shows a perspective view illustrating a sequence of movement of the components illustrated in FIG. 8 when the actuating shaft of the circuit breaker is rotating.

During this rotation, and as illustrated for example in FIG. 10, the portion 4 of the actuating shaft 3 impacts against the hooking plate 31, and for example against the first finger 32 and the hooking plate 31 can be caused to rotate around the hinging axis 105 relative to the mounting plate 11.

Figure 11:
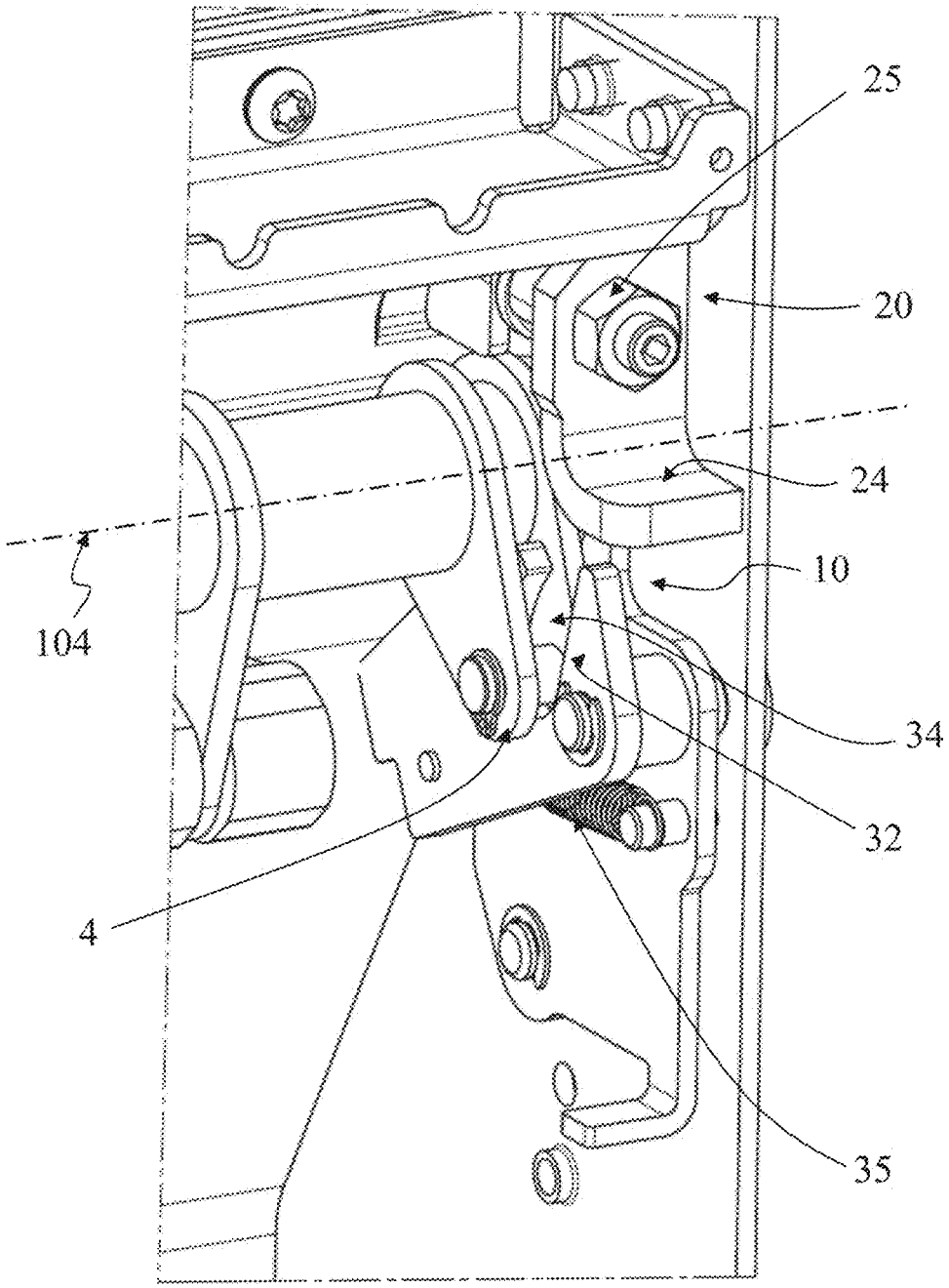
FIG. 11 shows another perspective view illustrating a sequence of movement of the components illustrated in FIG. 8 when the actuating shaft of the circuit breaker is rotating.

As a consequence, the portion 4 can slide deeply into the slot 34 and can remain trapped between the two fingers 32, 33, for example, as shown in FIG. 11. In accordance with an exemplary embodiment, the movable contacts 2 are prevented from bouncing back towards the fixed contacts 1.

When the actuating shaft is unlocked for example by a user, the return spring 35 can return the hooking plate 31 towards its initial position.

In accordance with an exemplary embodiment, the circuit breaker 100 according to the present disclosure, the actuating shaft 3 is not connected directly to the flanks of the circuit breaker but can be suspended to and supported by the supporting device 10. The previously disclosed tight coupling between the actuating shaft 3 and the bushing 18 can allow a more precise positioning of the shaft 3 itself. The precise positioning can be calibrated by the disclosed adjustment means. In accordance with an exemplary embodiment, the circuit breaker 100 according to the present disclosure can include the supporting device 10, which can incorporate the anti-rebound means 30 and the positions of the actuating shaft 3 and of the supporting device 10 can be adjusted simultaneously, and the relative position between the actuating shaft 3 and the anti-rebound means 30 can remain unchanged.

In accordance with an exemplary embodiment, the circuit breaker 100 as disclosed is susceptible of modifications and variations, all of which can be within the scope of the inventive concept including any combination of the above described embodiments which have to be considered as encompassed by the above description; all details can further be replaced with other technically equivalent elements. For example, the supporting device 10 and/or any of its part, for example, the anti-rebound-means 30, as well as the adjustment means 20, can have a different number of components assembled together or the components can be differently shaped provided they can be suitable for the scope they were conceived. The supporting device 10 can be connected to any suitable side flank or intermediate wall 101 of the circuit breaker, or more than one supporting device 10 can be used, for example, two supporting devices 10 can be positioned at the corresponding two side flanks 101 of the circuit breaker 100. Additional adjustment means and/or anti-rebound means of the type previously described or of different type can be also used. The actuating shaft 3 and or any of its parts can be differently shaped, the fixed contacts and/or the movable contacts as well as any of the kinematic chain connecting them with the actuating shaft 3, can be realized in a different number of components or be differently shaped. In accordance with an exemplary embodiment, it is possible to adjust the position of the actuating shaft 3 and of the supporting device 10 by screwing directly the nut onto the shank 23 until the desired position is achieved, etc.

In accordance with an exemplary embodiment, the materials, so long as they can be compatible with the specific use, as well as the individual components, can be any according to the requirements and the state of the art.

The term "adapted" or "arranged" or "configured" or "shaped", as used herein while referring to any component as a whole, or to any part of a component, or to a whole combinations of components, or even to any part of a combination of components, it has to be understood that it means and encompasses correspondingly either the structure, and/or configuration and/or form and/or positioning of the related component or part thereof, or combinations of components or part thereof, such term refers to.

The term transversal or transversally hereinafter used encompasses a direction non-parallel to the element or direction it is related to, and perpendicularity has to be considered a specific case of transverse direction.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A circuit breaker comprising:

a plurality of fixed contacts;

a plurality of corresponding movable contacts;

an actuating shaft which is operatively connected to and actuates the plurality of movable contacts between a first position in which each of the movable contacts are coupled with a corresponding fixed contact, and a second position in which each of the plurality of movable contacts are separated from the corresponding fixed contact;

a supporting device for the actuating shaft, wherein the supporting device is movably connected to a wall of the circuit breaker, and wherein the actuating shaft is operatively coupled to the supporting device so as to rotate around a rotation axis relative to the wall and the supporting device; and an adjustment means for adjusting a position of the actuating shaft relative to the wall.

2. The circuit breaker according to claim 1, comprising:

anti-rebound means configured to cooperate with the actuating shaft and prevent the movable contacts from bouncing back towards the fixed contacts when moving from the first position to the second position.

3. The circuit breaker according to claim 1, wherein the adjustment means is configured to simultaneously adjust the position of the actuating shaft and a position of the supporting device relative to the wall.

4. The circuit breaker according to claim 1, wherein the supporting device is hinged to the wall.

5. The circuit breaker according to claim 4, wherein the supporting device is configured to swivel about a hinged axis.

6. The circuit breaker according to claim 1, wherein the adjustment means is configured to displace the actuating shaft along a reference axis, which is transverse to a rotation axis.

7. The circuit breaker according to claim 6, wherein the adjustment means is configured to swivel at the same time the supporting device swivels about a hinged axis.

8. A circuit breaker comprising:

a plurality of fixed contacts;

a plurality of corresponding movable contacts;

an actuating shaft which is operatively connected to and actuates the plurality of movable contacts between a first position in which each of the movable contacts are coupled with a corresponding fixed contact, and a second position in which each of the plurality of movable contacts are separated from the corresponding fixed contact;

a supporting device for the actuating shaft, wherein the supporting device is movably connected to a wall of the circuit breaker, and wherein the actuating shaft is operatively coupled to the supporting device so as to rotate around a rotation axis relative to the wall and the supporting device;

an adjustment means for adjusting a position of the actuating shaft relative to the wall;

anti-rebound means configured to cooperate with the actuating shaft and prevent the movable contacts from bouncing back towards the fixed contacts when moving from the first position to the second position; and wherein the supporting device comprises:

a pin which is hinged on one side to the wall; and a shaped mounting plate, the shaped mounting plate having a hole fitted with a bushing, which receives a portion of the actuating shaft.

9. The circuit breaker according to claim 8, wherein the shaped mounting plate comprises:

one bent portion forming a first hook and a second hook with a slit in between.

10. The circuit breaker according to claim 9, wherein the anti-rebound means comprises:

a hooking plate which is coupled to a second end of the pin so as to swivel about a hinging axis with the shaped mounting plate under an action of the adjustment means and is configured to rotate around the hinging axis relative to the mounting plate under an action of the actuating shaft.

11. The circuit breaker according to claim 10, wherein the hooking plate comprises:

a first finger and a second finger delimiting there between an open slot, the first and second fingers being configured to mechanically interact with an associated portion of the actuating shaft and to guide the associated portion inside the open slot when the actuating shaft rotates so as to actuate the movable contacts from the first position to the second position.

12. The circuit breaker according to claim 11, wherein the anti-rebound means comprises:

a return spring which is positioned between the shaped mounting plate and the hooking plate, the return spring having a first end hooked to a first connection pin protruding from the shaped mounting plate towards the hooking plate and a second end hooked to a second connection pin protruding from the hooking plate towards the shaped mounting plate.

13. The circuit breaker according to claim 9, wherein the adjustment means comprises:

an adjustment screw having a head, which is inserted into the slit between facing surfaces of the first and second hooks and a shank, which runs inside the second hook and passes through a hole provided on a protrusion protruding transversally from the wall.

14. The circuit breaker according to claim 10, wherein the adjustment means comprises:

a nut, which is connected to the adjustment screw.

15. A circuit breaker comprising:

a plurality of fixed contacts;

a plurality of corresponding movable contacts;

an actuating shaft which is operatively connected to the plurality of movable contacts for actuating the movable contacts between a first position in which each of the movable contacts are coupled with a corresponding fixed contact, and a second position in which each of the movable contacts are separated from the corresponding fixed contact; and a supporting device for the actuating shaft, wherein the supporting device is movably connected to a wall of the circuit breaker, and wherein the actuating shaft is operatively coupled to the supporting device so as to rotate around a rotation axis relative to the wall and the supporting device.

16. The circuit breaker according to claim 15, comprising:

an adjustment means for adjusting a position of the actuating shaft relative to the wall.

17. The circuit breaker according to claim 16, comprising:

anti-rebound means configured to cooperate with the actuating shaft and prevent the movable contacts from bouncing back towards the fixed contacts when moving from the first position to the second position.

18. The circuit breaker according to claim 16, wherein the adjustment means is configured to simultaneously adjust the position of the actuating shaft and a position of the supporting device relative to the wall.

19. The circuit breaker according to claim 16, wherein the supporting device is hinged to the wall, and the supporting device is configured to swivel about a hinged axis.

20. The circuit breaker according to claim 16, wherein the adjustment means is configured to displace the actuating shaft along a reference axis, which is transverse to a rotation axis, and wherein the adjustment means is configured to swivel at the same time the supporting device swivels about a hinged axis.

* * * * *